United States Patent [19]

DuBois et al.

[11] 4,328,963

[45] May 11, 1982

[54] COMPACT SORTER

[75] Inventors: R. Clark DuBois, Fairfield; John C. Hamma, Milford, both of Conn.

[73] Assignee: Gradco Dendoki, Inc., Newport Beach, Calif.

[21] Appl. No.: 98,546

[22] Filed: Nov. 29, 1979

[51] Int. Cl.[3] ..... B65H 39/11

[52] U.S. Cl. ..... 271/293; 271/288; 271/294; 271/209

[58] Field of Search ..... 271/293, 294, 292, 295, 271/287, 288, 209, 188; 270/58

[56] References Cited

U.S. PATENT DOCUMENTS 3,721,435 3/1973 Zanders ..... 271/293

4,203,587 5/1980 Kishi et al. ..... 271/293

FOREIGN PATENT DOCUMENTS 2017622 10/1979 United Kingdom ..... 271/209

OTHER PUBLICATIONS

Swanson, R. M., *Xerox Disclosure Journal,* vol. 1, Nos. 9/10, Sep./Oct. 1976, pp. 39, 40.

*Primary Examiner*—Bruce H. Stoner, Jr.

*Attorney, Agent, or Firm*—Newton H. Lee, Jr.

[57] ABSTRACT

A sorting machine is provided for attachment to a copying machine to receive successive sheets from an outlet from the copying machine. The sorting machine has plural trays mounted to move progressively past the sheet outlet in opposite directions, the trays being relatively close together when positioned at either side of the outlet, but adjacent trays being widely spaced to accommodate the incoming sheets from the outlet. The trays are fed past and spaced at the outlet by driven members at opposite sides of the tray which engage and shift stacked trays in succession. The driven members are notched discs functioning as a linear Geneva movement. The remote ends of the trays are freely supported one on the other for relative longitudinal and pivotal movement.

16 Claims, 9 Drawing Figures

S
C
T
R
10
11
11a
11b
12
13
14
15
16
16a
16b
16c
18
18a
18b
19
20
20a
21
22
23
24
30
30a
41
45
50
51
52
60
61
62
63
64
65
66
68
112

24
11b
22
23
7
7
10
13
11

14
16a
30
15
203
21
5
5
66
45
68
30a
16c
60
11a
17
16b
18b
19
18
18a
12
17a
112
C
T
62
61
63
64
65

COMPACT SORTER

BACKGROUND OF THE INVENTION

Over the years, as copying machines have been more widely used to produce multiple sets of copies of multiple page documents, sorting machines have been devised to accommodate the copy sheets and sort them into collated sets as they leave the copy machine.

Efforts have been made to accommodate larger numbers of sets and to reduce the space occupied by the sorter, by shifting trays to facilitate the distribution of the sheets, as shown and described, for example in U.S. Pat. Nos. 3,774,902, 3,788,640 and 4,055,339.

Some of the prior devices while adapting the sorter to receive a large number of sets or a large number of sheets per set have been adapted by a sheet transport to transfer sheets from the copying machine to a given tray or bin location, at which the sheet is deflected into the bin. As disclosed in the pending U.S. patent application, Ser. No. 936,724, filed Aug. 25, 1978, by Frederick J. Lawrence, now U.S. Pat. No. 4,235,435, space can also be effectively saved by nesting the sheet deflectors and extending their length.

Nevertheless, there has remained a need in the industry for a small, simple and compact sorter which can be applied to copiers, as original equipment, or as a later attachment, to receive copy sheets from the outlet of the copy machine and sort the sheets into a number of collated sets, without requiring special transport means to carry the sheets from the outlet to the sorting trays or bins, and without occupying a large space for the sorting apparatus. Such a compact sorter is the subject of the pending application of Frederick J. Lawrence, filed Nov. 27, 1979, Ser. No. 098,191.

SUMMARY OF THE INVENTION

The present invention relates to such a compact sorter which is relatively simple to manufacture and install on a variety of copying machines, and which is inexpensive, but simple to use.

It is a principal object of the present invention to provide an improved, small or compact sorter applicable to copying machines without electrical interface.

More particularly, it is an object of the invention to provide moving bin or tray sorting apparatus which is simple and reliable, yet inexpensive and easy to use.

Another object is to provide a sorting structure and a simple mount for supporting the sorting structure on a copying machine in a manner whereby the sheet discharge transport of the copying machine feeds the sheets into the sorter.

The present invention, in accomplishing these objectives, provides a shifting bin or tray sorting apparatus which can be readily applied to existing sorting machines, wherein the sorting function or shifting of the bins is controlled without requiring electrical interface with the copier.

The bins or trays are adapted to be shifted, progressively in opposite directions, past the sheet outlet from the copier and to receive copies of successive originals while shifting in opposite directions, to minimize delay in the flow of copies to the sorter.

Shifting of the bins in opposite directions is accomplished by novel, simple transfer means, whereby the bins are moved from a first, compact or closely spaced relation, at one side of the sheet outlet from the copier to a second, compact or closely spaced relation, at the other side of the sheet outlet from the sorter, while adjacent trays are widely spaced to accommodate sheet entry, as the trays are intermittently stopped to receive a sheet.

The transfer or bin shifting means includes a pair of feed elements rotatably mounted adjacent each side of the bins or trays and adapted to engage trunnions at opposite sides of the bins in a successive manner to move them between the first and second closely spaced relations. The preferred form shown herein includes Geneva wheels driven and halted, to provide the wide opening for a sheet, by a motor controlled by a time delay system. At least the sheet inlet ends of the bins or trays are supported on trunnions which stack in abutting engagement. The trunnions are successively shifted by a Geneva wheel past the sheet inlet position, to engage the trunnions of an adjacent tray and move the previously shifted tray or trays in closely spaced condition. The trays receive sheets while being shifted in opposite directions. While the members shown are in the form of Geneva wheels, other transfer devices may be employed which operate to successively engage and shift the trays which are supported one on the other for pivotal and relative longitudinal movements.

In accomplishing the foregoing, the present invention provides a transfer mechanism which operates in a manner whereby the transfer elements are moved more rapidly during the period when the transfer elements are moving between bin shifting positions than when shifting bins so that the sorting apparatus is properly timed to the copy cycle of the copying machine.

Another object is to provide a shifting bin sorter of the type referred to above, wherein the trays are supported one on the other at their ends remote from the copier in a manner facilitating removal of sorted sets of copies either longitudinally from between trays or laterally, as may be desired by a user.

This invention possesses many other advantages and has other purposes which may be made more clearly apparent from a consideration of the forms in which it may be embodied. The preferred form is shown in the drawings accompanying and forming part of the present application. It will now be described in detail, for the purpose of illustrating the general principals of the invention; but it is to be understood that such detailed description is not to be taken in a limiting sense.

DESCRIPTION OF A PREFERRED EMBODIMENT

Figure 1:
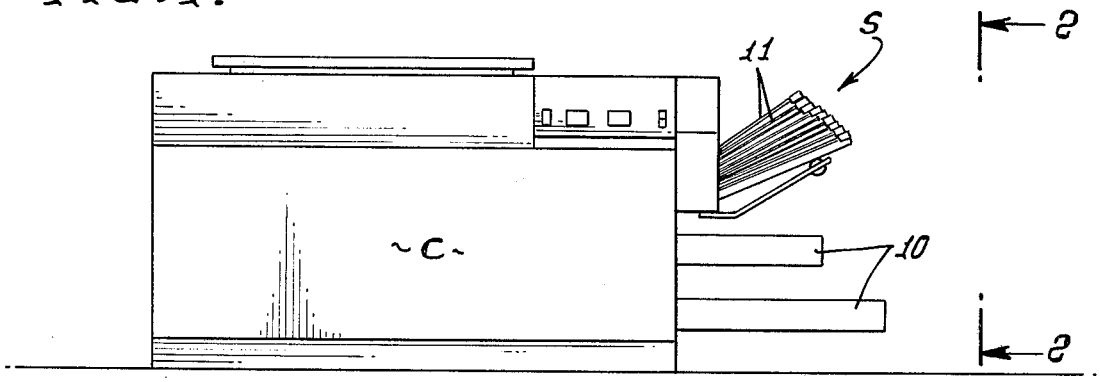
FIG. 1 is a side elevation of a copier and sorter in accordance with the invention.
Figure 2:
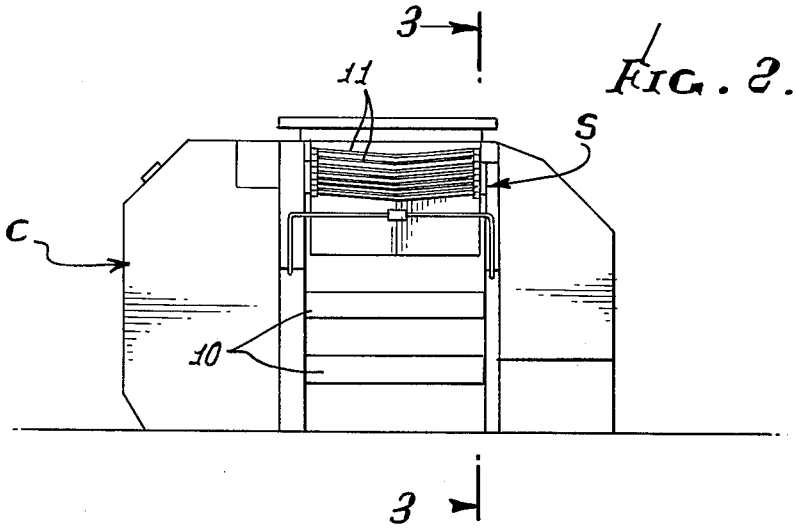
FIG. 2 is an end elevation as viewed on the line 2—2 of FIG. 1.

As seen in the drawings, a copier C, of the xerographic type, for example, has a copy sorter S mounted thereon, whereby successive copies of originals can be made on sheets of plain paper supplied from one or more supply cassettes 10, and the copies can be collated into sorted sets, as is well known.

The present sorter is constructed according to the invention in a simple, compact manner so as to be applicable to numerous copiers, without requiring substantial modification of the copier.

Figures 3, 6:
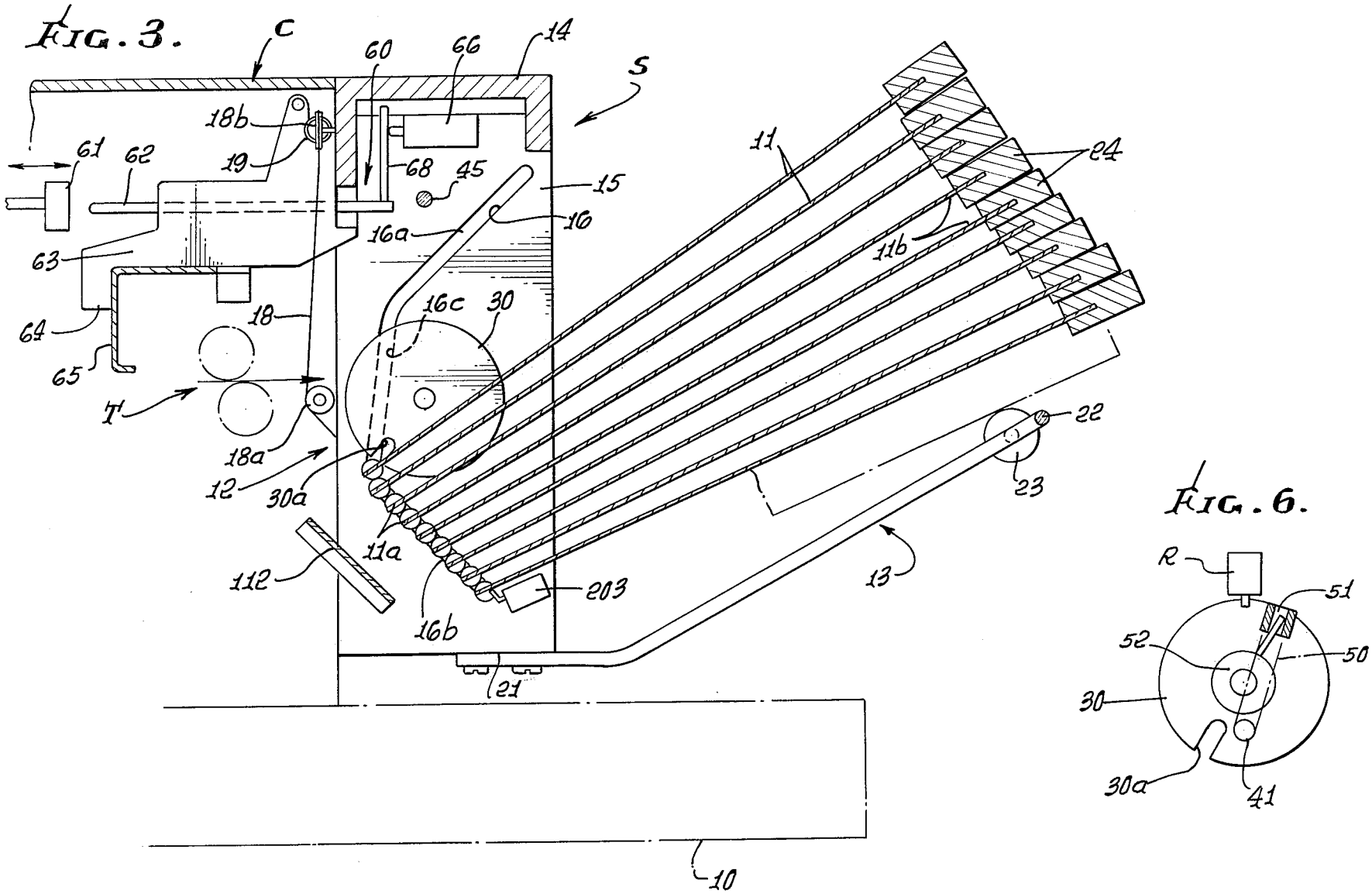
FIG. 3 is an enlarged vertical section on the line 3—3 of FIG. 2, showing the bins in a non-sorting or start-sorting condition.
FIG. 6 is a section on the line 6—6 of FIG. 5, showing the differential speed drive for shifting the bins.
Figure 4:
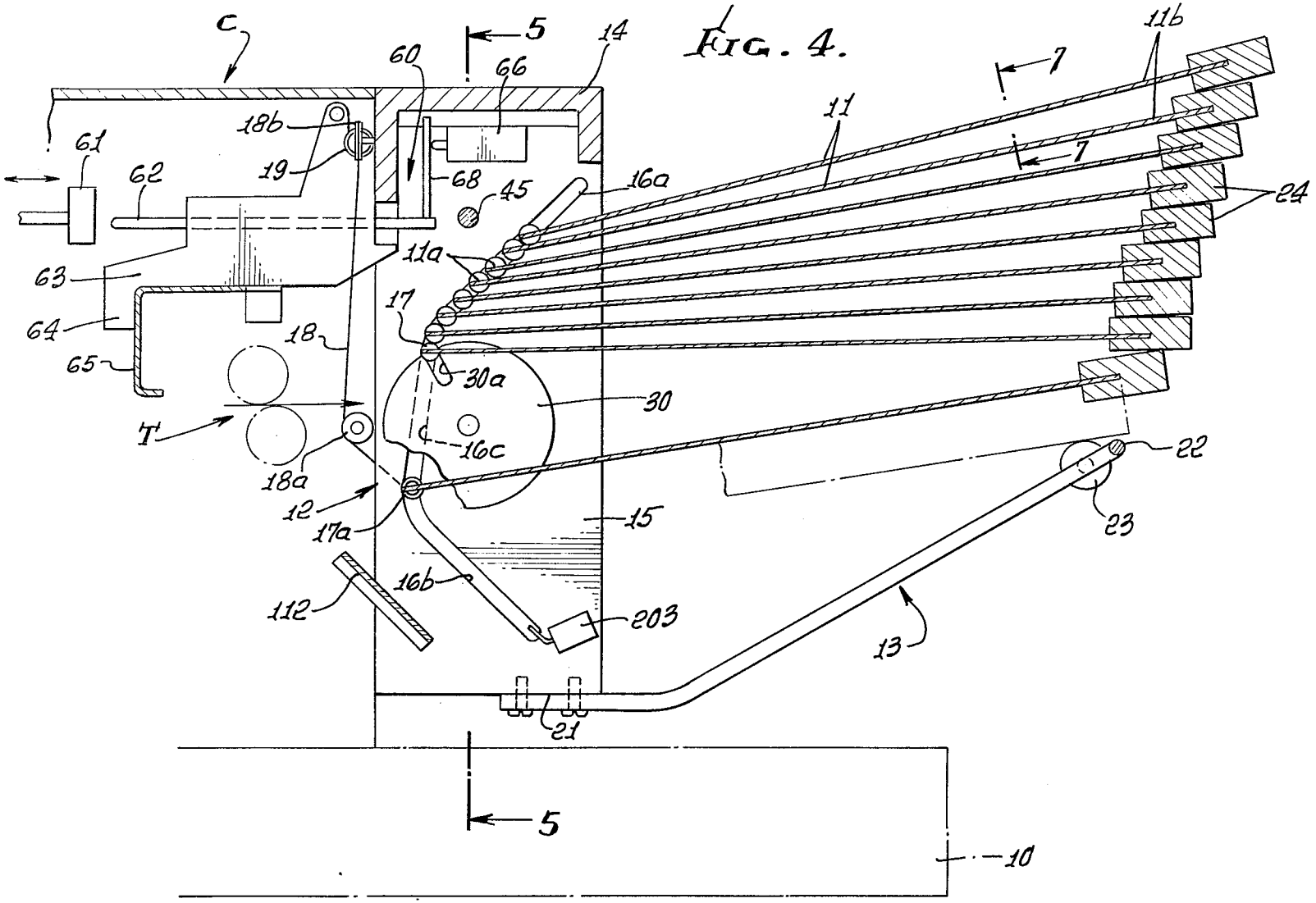
FIG. 4 is a view corresponding with FIG. 3, but showing the bins in a condition shifted from the position of FIG. 3 during sorting of a complete set of copies.

Copies are fed from the copier onto a number of vertically spaced, shiftable bins or trays 11, from the conventional transport means T of the copier (FIGS. 3 and 4). Trays 11 are vertically shiftable at their ends 11*a* adjacent to the copier by transfer means 12, while the distal or outer ends 11*b* of the trays are supported for relative pivotal and longitudinal movement on support means 13, as well as on one another, as will be later described.

Figure 5:
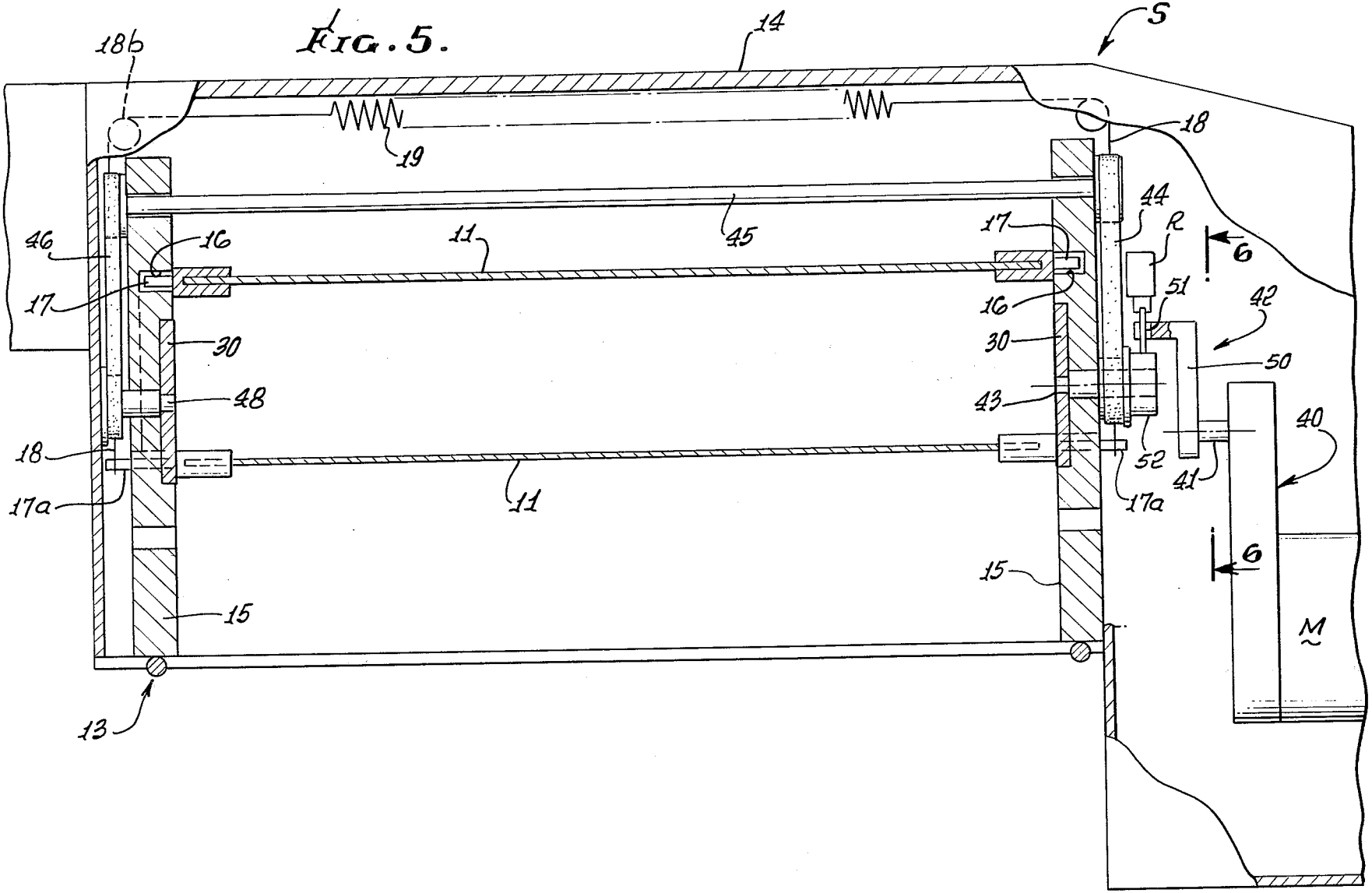
FIG. 5 is a transverse section on the line 5—5 of FIG. 4.
Figure 8:
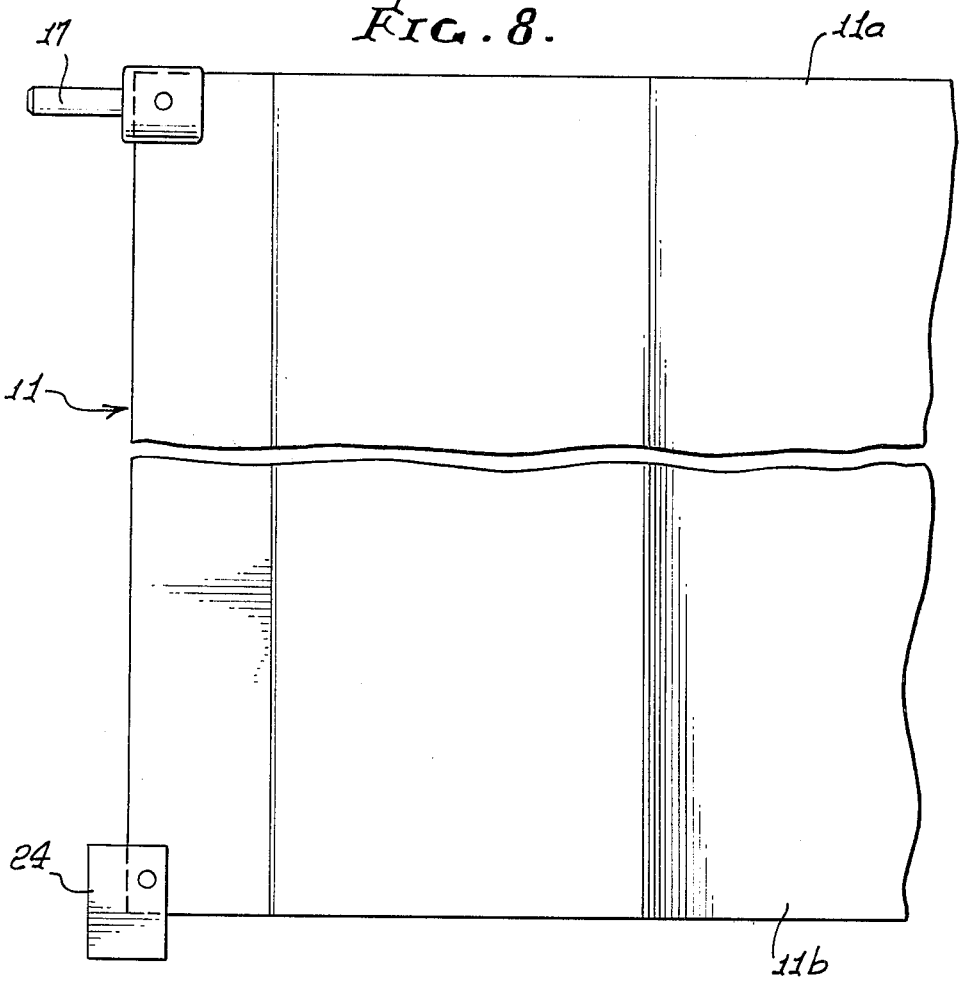
FIG. 8 is a fragmentary detail, on the line 8—8 of FIG. 7, showing the details of the bin construction.

Referring to FIGS. 3, 4 and 5, a frame structure 14 has laterally spaced and vertically disposed guide plates 15 having opposing guide slots 16 which have an upper section 16*a*, a lower section 16*b*, oppositely inclined from an intermediate section 16*c*. Ends 11*a* of the trays 11 have pins 17 which extend laterally into the slots 16 for sliding movement therein, during operation of the sorter. The lowermost bin pins 17*a* are laterally extended to extend through the members 15 (see FIG. 5), and to be connected to lines 18 adapted to apply an upward force to the tray ends 11*a*, by means of a coiled tension spring 19, connected at opposite ends to the lines 18, at opposite sides of the frame structure 14, whereby the tray supports 17 are all vertically biased to be engaged by the transfer means 12.

At their outer ends 11*b*, the trays 11 are supported on a support member, which is mounted on the frame structure, as at 21, and has an outer end 22 provided with an anti-friction roller 23, disposed beneath the lowermost tray 11, adjacent its outer end 11*b*. Each tray has bearing members 24 at its outer corners which slideably support the distal tray ends 11*b* one on the other for relative longitudinal and angular movements during shifting of the trays by the shifting means 12. Since the pins 17 support the inner ends 11*a* of the trays in a pivotal manner in the slots 16, the trays 11 can be opened pivotally, at their outer or distal ends, to enable removal of sets of copies from between the trays, either endwise or laterally, as may be desired.

Lines 18 extend over pulleys 18*a* arranged to align the pull on the lines 18 with the lower angular section 16*b* of the track 16, the lines 18 then extending over pulleys 18*b* which align the lines 18 with the spring 19, thereby minimizing friction during shifting of the trays 11.

The transfer means 12, according to the present invention, is a simple structure incorporated in the end plates 15, in the preferred form of a pair of oppositely disposed transfer wheels 30 operable like a Geneva movement, to successively move the tray ends 11*a* past the location of the sheet transport means T, upwardly and downwardly, depending upon the number of sets of copies to be sorted or collated.

Each wheel 30 has a radially opening slot or notch 30*a* adapted to receive a tray pin 17 and move the pin 17 through the slot section 16*c*, between slot sections 11*b* and 16*c*, upon reversal of direction of rotation of the wheels 30. Slot section 16*c* is straight and extends chordally relative to the wheel 30. The tray pins 17 extend through slot 16*c* into the radial notch 30*a* of the wheel 30. The notch is deeper than the thickness of pins 17 to allow the pin to move radially with respect to the center of the wheel.

As seen in FIG. 5, a motor M drives through a suitable gear drive 40, a drive shaft 41. Shaft 41 drives through a differential speed mechanism 42, later to be described, a shaft 43, on which one transfer wheel 30 is mounted. A chain or belt 44 is driven by shaft 43 and drives synchronously, a shaft 45 and another chain or belt 46, at the other side of the apparatus whereby the other transfer wheel or member 30, on a driven shaft 48, is driven at the same rate and period as the transfer wheel on the shaft 43.

While the drive from shaft 41 to shaft 43 may be of a uniform speed, it is preferred that the drive 42 be such that the trays are shifted past the sheet feeding transport T at a first low speed, and that the Geneva wheels 30 move at a higher speed, following shifting of a tray. Such an arrangement enables effective operation of the sorter with a copier which produces multiple copies at a high rate of speed. As seen in FIGS. 5 and 6, such a drive is provided by a structure including a drive yoke member 50 on drive shaft 41 having a pin and slot connection 51 with a driven member 52 on shaft 43, shafts 41 and 43 being on offset centers, whereby the rate of travel of the driven member 52 is greatest during movement through an arc when the transfer wheel slots 30*a* are moving through an arc following transfer of a pin 17 between guide slot sections 16*a* and 16*b*.

During operation, it is desired that trays 11 be shifted during a sorting or collating mode, in succession from the non-sort condition of FIG. 3, to the alternate location shown in FIG. 4, or that a number of the trays be so shifted, depending on the number of sets. The apparatus during such sorting operations works to shift a selected number of trays successively upwardly and downwardly past the sheet transport T to provide a wide space, FIG. 4, to receive a sheet, while the other trays are closely spaced. When the apparatus is in a non-sort mode, multiple copies of an original will be deposited on the uppermost tray (FIG. 3), and the copy is clearly visible.

Sorting control, in accordance with a feature of the invention, is provided by the copier itself. As shown, such sorting control is provided by a means 60 which is activated by a carriage 61 of a type of copier having a scanning carriage, as is well known, which reciprocates once per copy being made. Such a scanning carriage can supply to the sorter information as to the number of copies of a single original being reproduced, while, as will be later described, a predetermined lapse of time in the scan operation can be utilized to indicate the production of copies of a next original.

As shown, the scan detector 60 is incorporated in a simple means for mounting the sorter on a conventional copier. A push rod 62 is reciprocably mounted in a support bracket 63. The bracket 63, two of which are provided in laterally spaced relation, has a lug 64 engageable behind a cross frame member 65 of a copier, to hang the sorter on the copier, in a location at which the push rod 62 is disposed in the path of the scan carriage 61 of the copier. Push rod 62 has a pin or other portion 68 engageable with a springloaded switch 66, so that each reciprocation of the carriage 61 will activate the switch 66, and the switch spring or other spring means will return the push rod 62.

With the foregoing in mind, it will be understood that in the non-sort mode of operation successive copies of originals will be fed from the copier by transport T and deposited on the uppermost tray as seen in FIG. 3. When sets of copies are to be sorted, it is desired that the trays be successively moved from the positions of FIG. 3 to the position of FIG. 4, depending upon the number of sets to be sorted, and back to the positions of FIG. 3. At each time that a copy is being fed from transport T during the sorting operation, the trays are widely spaced, as seen in FIG. 4, to receive the copy, but at all other times the trays are all closely spaced, to provide a compact structure.

Figure 7:
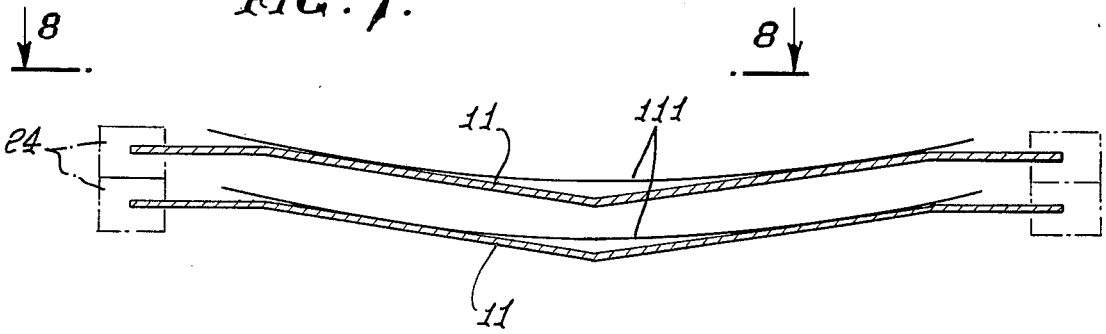
FIG. 7 is a fragmentary transverse section on the line 7—7 of FIG. 4, showing the bin configuration.

The copy sheets are fed from transport T onto the trays 11, and preferably, for the sake of compactness, the trays may be relatively short, due to the tray formation best seen in FIG. 7, wherein it will be seen that the trays, at least at their outer ends 11*b*, are concave or angular to cause the sheets of paper 111 to be arched, thereby resisting sagging or bending over the ends 11*b* of the trays. In this connection, a paper guide or stop 112 is provided to prevent the sheets from sliding lengthwise down the inclined trays, when they are below the transport, as seen in FIG. 3.

Since the trays are to be moved one by one past the transport T, a switch is provided to limit revolution of the transfer wheels to one revolution. As seen in FIG. 5, the single revolution switch is designated R and, as seen in FIG. 6, the switch R, may be operated, cyclically, by the yoke 51 to arrest drive of the transfer mechanism following each single revolution.

Figure 9:
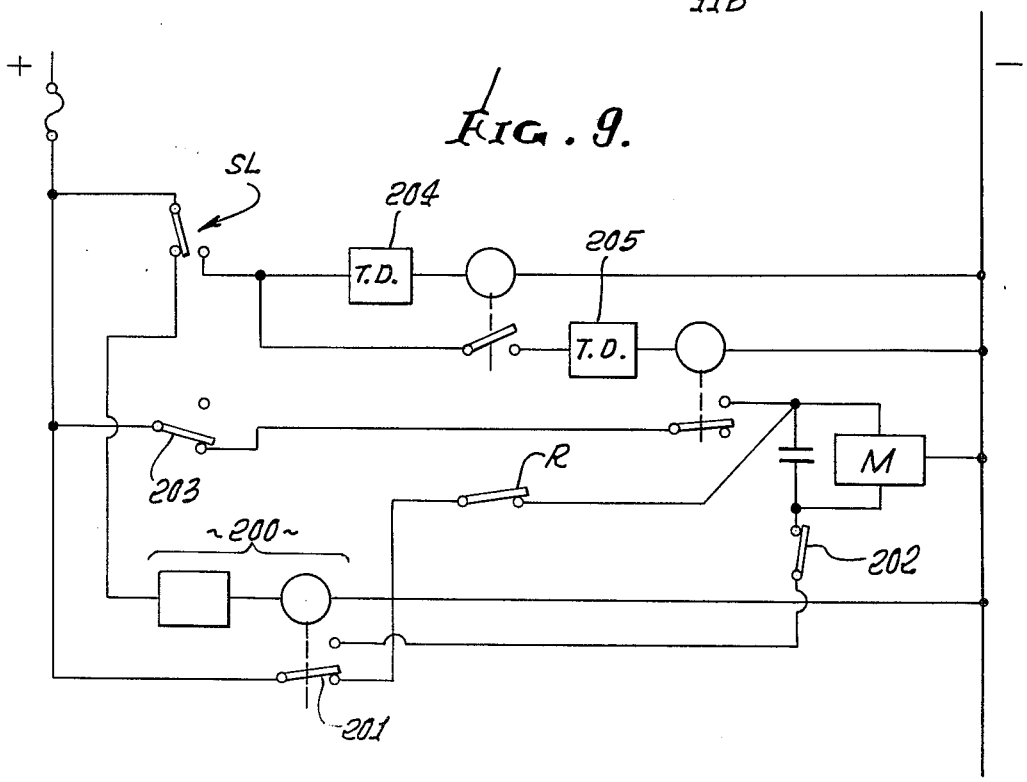
FIG. 9 is a schematic illustration of control means enabling operation of the sorter without electrical interface with the copier.

Referring to FIG. 9, a typical control system is shown whereby the sorter can sort a selected number of copy sets in response to operation of the copier without requiring interface with the electrical system of the copier. However, certain interface can be resorted to such as power supply and copy detection.

A power source is shown as having a control system including a carriage switch SL (Switch 66 described above) which is normally closed, in circuit with a time-delay relay 200 having a normally closed contact 201 in circuit with the normally closed home switch or one revolution switch R and the motor M. A trays home (all down) switch 202 is also in circuit with motor M, so that motor M will drive the transfer wheels 30 one revolution, if sort switch 203 is closed. Time delays 204 and 205 are provided to cause the motor to be initially energized and to drive the bin transfer through one revolution and to de-energize the motor M if a time delay occurs, in the operation of the copier, indicating that another original is being copied. Such time delay is intended to cause the system to shift another tray upwardly or downwardly in the sorting process. Clearly, various control systems may be employed to cause the operation of the tray shifting means 30 in the desired sequence.

From the foregoing, it will now be apparent that the present invention provides a compact sheet sorting apparatus, applicable to copying machines in a simple manner, which can be inexpensively manufactured and installed, and which has a unique combination of tray shifting means and interdependent tray supporting means which facilitates unloading of copy sets.

We claim:

1. An improved sorting apparatus of the shiftable bin type including a frame structure having means for mounting the sorting apparatus at the sheet outlet from a copying machine, sorting bins pivotally shiftable relative to one another to provide a wide sheet entry between bins at said outlet, and means for shifting the bins, the improvement wherein said bins have ends remote from said outlet freely pivotally mounted one on the other enabling vertical separation of said remote ends from one another and ends adjacent said outlet mounted for pivotal movement on horizontal axes and for vertical shifting movement past said outlet, and said means for shifting said bins engages successive bins at said ends adjacent to said outlet to move the latter successively pivotally from one side of said outlet to the other in opposite directions, spring means biasing said ends adjacent said outlet into engagement with said shifting means, and including control means to intermittently effect operation of said shifting means in opposite directions following passage into successive bins from the copying machine of a selected number of sheets.

2. Improved sorting apparatus as defined in claim 1, said shifting means including rotary Geneva members engageable with successive bins and operative to effect longitudinal movement of said bins during shifting of said bins past said outlet.

3. Improved sorting apparatus as defined in claim 1, said shifting means including rotary Geneva members engageable with successive bins and operative to effect longitudinal movement of said bins during shifting of said bins past said outlet, said control means including means permitting single revolution of said Geneva members in opposite directions.

4. Improved sorting apparatus as defined in claim 1, including a tray above said bins for receiving successive sheets from said outlet when the ends of said bins adjacent said outlet are all positioned below said outlet, said control means including means for positioning said tray and all of said bins except one above said outlet.

5. Improved sorting apparatus as defined in claim 1, said shifting means including rotary Geneva wheels rotatably supported on horizontal axes at opposite sides of said bins and having a radial notch, said bins having trunnions engageable in said notches of said Geneva wheels and pivotally supporting said bins.

6. Improved sorting apparatus as defined in claim 1, said shifting means including rotary Geneva wheels rotatably supported on horizontal axes at opposite sides of said bins and having a radial notch, said bins having trunnions engageable in said notches of said Geneva wheels and pivotally supporting said bins, said frame structure having vertically extended guide grooves slideably and pivotally receiving said trunnions.

7. Improved sorting apparatus as defined in claim 1, said bins being transversely concave adjacent said remote ends to cause a sheet to be transversely arched.

8. Improved sorting apparatus as defined in claim 1, said bins having bearing members at opposite sides thereof adjacent said remote ends longitudinally slideably supporting said bins one on the other.

9. Improved sorting apparatus as defined in claim 1, said bins having bearing members at opposite sides thereof adjacent said remote ends longitudinally slideably supporting said bins one on the other, and including a support beneath the lowermost bin longitudinally slideably and pivotally supporting said lowermost bin.

10. Improved sorting apparatus as defined in claim 1, said bins having bearing members at opposite sides thereof adjacent said remote ends longitudinally slideably supporting said bins one on the other, said bearing members having opposed longitudinally extended contacting surfaces of a length exceeding the longitudinal excursion of said bins.

11. An improved sorting apparatus comprising: a frame structure, a plurality of bin members shiftably disposed in said frame structure; means for successively moving said bin members in said frame between first and second positions at which said bin members are at opposite sides of a horizontal sheet entry location and in closely spaced relation and for widely vertically spacing successive bins at said entry location to receive a sheet at said entry location, said means for moving said bin members comprising supports at opposite sides of said bin members in abutting relation when said bin members are in said first and second positions; a driven bin shifting Geneva wheel having a radial notch engageable with successive supports at at least one side of each bin to move said bins from one side of said entry location to the other, drive means to intermittently drive said Geneva wheel rotatively in opposite directions, and means resiliently biasing said bins in at least one direction towards said Geneva wheel to engage said supports with said Geneva wheel and force said supports into said notch upon rotative movement of said Geneva wheel, said frame structure having a vertical guide slot chordally intersecting said Geneva wheel, said supports extending through said slot to engage the periphery of said Geneva wheel, whereby said trays are held spaced apart by said Geneva wheel, said radial notch being of a length greater than the thickness of said supports.

12. An improved sorting apparatus comprising: a frame structure, a plurality of bin members shiftably disposed in said frame structure; means for successively moving said bin members in said frame between first and second positions at which said bin members are at opposite sides of a horizontal sheet entry location and in closely spaced relation and for widely vertically spacing successive bins at said entry location to receive a sheet at said entry location, said means for moving said bin members comprising supports at opposite sides of said bin members in abutting relation when said bin members are in said first and second positions; a driven bin shifting Geneva wheel having a radial notch engageable with successive supports at at least one side of each bin to move said bins from one side of said entry location to the other, drive means to intermittently drive said Geneva wheel rotatively in opposite directions, and means resiliently biasing said bins in at least one direction towards said Geneva wheel to engage said supports with said Geneva wheel and force said supports into said notch upon rotative movement of said Geneva wheel, said drive means including a differential speed drive for driving said Geneva wheel at a slow speed while shifting a bin and at a greater speed to engage a next bin.

13. An improved sorting apparatus as defined in claim 11, including a pair of said Geneva wheels at opposite sides of said bins, said frame structure having opposed vertically extending guide slots, said supports extending laterally through said guide slots to engage said Geneva wheels and being in the form of trunnions pivotally supporting said bins for relative pivotal movement on horizontal axes to be opened at the ends of said bins remote from said entry location.

14. An improved sorting apparatus as defined in claim 11, including a pair of said Geneva wheels at opposite sides of said bins, said frame structure having opposed vertically extending guide slots, said supports extending laterally through said guide slots to engage said Geneva wheels and being in the form of trunnions pivotally supporting said bins for relative pivotal movement on horizontal axes to be opened at the ends of said bins remote from said entry location, said resilient means being spring means biasing said trunnions in at least one direction to engage said Geneva wheels.

15. An improved sorting apparatus, comprising: a frame structure, a plurality of bin members shiftably disposed in said frame structure; means for successively moving said bin members in said frame between first and second positions at which said bin members are at opposite sides of a horizontal sheet entry location and in closely spaced relation and for widely vertically spacing successive bins at said entry location to receive a sheet at said entry location, said means for moving said bin members comprising supports at opposite sides of said bin members in abutting relation when said bin members are in said first and second positions; a driven bin shifting Geneva wheel having a radial notch engageable with successive supports at at least one side of each bin to move said bins from one side of said entry location to the other, drive means to intermittently drive said Geneva wheel rotatively in opposite directions, and means resiliently biasing said bins in at least one direction towards said Geneva wheel to engage said supports with said Geneva wheel and force said supports into said notch upon rotative movement of said Geneva wheel, including a pair of said Geneva wheels at opposite sides of said bins; said frame structure having opposed vertically extending guide slots, said supports extending laterally through said guide slots to engage said Geneva wheels and being in the form of trunnions pivotally supporting said bins for relative pivotal movement on horizontal axes to be opened at the ends of said bins remote from said entry location, said bins freely extending from said frame structure and being unobstructed by said frame structure to enable lateral and endwise removal of sheets from between said bins.

16. An improved sorting apparatus of the shiftable bin type including a frame structure having means for mounting the sorting apparatus on a copying machine at the sheet outlet from the copying machine, sorting bins shiftable relative to one another to provide a wide sheet entry between bins at said outlet, and means for shifting the bins, the improvement wherein said bins have ends remote from said outlet pivotally arranged and ends adjacent said outlet mounted for shifting movement past said outlet, and said means for shifting said bins engages successive bins at said ends adjacent to said outlet to move the latter successively from one side of said outlet to the other, spring means acting on said bins to bias said bins in at least one directon into engagement with said shifting means, and including control means to intermittently effect operation of said shifting means in opposite directions following passage of sheets into successive bins from the copying machine, means guiding said bins at said ends adjacent to said outlet for uniform movement past said outlet including portions of said bins engaged with one another to space said bins at opposite sides of said outlet, said control means including means for shifting successive bins in one direction responsive to the passage of a sheet through said entry location, and time delay means responsive to a time delay in the passage of successive sheets into successive bins to cause said bins to be shifted by said drive means to one side of said entry location.

* * * * *